US010570571B2

(12) United States Patent
Carrillo Lostao

(10) Patent No.: US 10,570,571 B2
(45) Date of Patent: Feb. 25, 2020

(54) BEARING ASSEMBLY, ARRANGEMENT OF BEAMS FOR CHANGING DIRECTION OF A CARRIAGE WITH THE BEARING ASSEMBLY AND RAIL-CHANGING SYSTEM WITH SAID BEARING ASSEMBLY AND ARRANGEMENT OF BEAMS

(71) Applicant: Luis Carrillo Lostao, Barcelona (ES)

(72) Inventor: Luis Carrillo Lostao, Barcelona (ES)

( * ) Notice: Subject to any disclaimer, the term of this patent is extended or adjusted under 35 U.S.C. 154(b) by 368 days.

(21) Appl. No.: 15/436,878

(22) Filed: Feb. 20, 2017

(65) Prior Publication Data

US 2017/0241081 A1 Aug. 24, 2017

(30) Foreign Application Priority Data

Feb. 22, 2016 (ES) ..... 201630199

(51) Int. Cl.

| | |
|---|---|
| ***E01B 7/00*** | (2006.01) |
| ***B61B 3/02*** | (2006.01) |
| ***E01B 25/26*** | (2006.01) |
| ***B61B 3/00*** | (2006.01) |

(52) U.S. Cl.

CPC ..... *E01B 7/00* (2013.01); *B61B 3/00* (2013.01); *B61B 3/02* (2013.01); *E01B 25/26* (2013.01)

(58) Field of Classification Search

CPC .. B61B 3/00; B61B 3/02; B61B 13/04; B61L 5/00; B61L 7/00; E01B 25/00; E01B 25/06; E01B 25/12

See application file for complete search history.

(56) References Cited

U.S. PATENT DOCUMENTS 4,354,434 A * 10/1982 Dehne ..... B60M 1/30 104/103

5,419,260 A * 5/1995 Hamilton ..... B61B 3/02 104/89

* cited by examiner

*Primary Examiner* — Robert J McCarry, Jr.

(57) ABSTRACT

A rail-changing system for air transport systems that comprises a bearing assembly and an arrangement of beams for changing direction, in which the bearing assembly is of the type that is linked to a carriage of an air transport system on beams, and comprises a frame linked to a pair of extensions defining a configuration similar to a yoke, each extension comprising a pair of main wheels with a common rotational axis arranged horizontally, and the main wheels being able to circulate on a beam; the bearing assembly also comprises at least one cam arranged on a rotating basis between the extensions, such that the rotational axis of the cam is arranged vertically, the arrangement of the beams for changing direction of a carriage with a bearing assembly and the beams being rails of the passive type.

14 Claims, 13 Drawing Sheets

BEARING ASSEMBLY, ARRANGEMENT OF BEAMS FOR CHANGING DIRECTION OF A CARRIAGE WITH THE BEARING ASSEMBLY AND RAIL-CHANGING SYSTEM WITH SAID BEARING ASSEMBLY AND ARRANGEMENT OF BEAMS

RELATED APPLICATION

This application claims the benefit of priority of Spanish Patent Application No. P201630199 filed on Feb. 22, 2016, the contents of which are incorporated herein by reference in their entirety.

FIELD AND BACKGROUND OF THE INVENTION

The aim of the present application is to register a bearing assembly, an arrangement of beams and a rail-changing system that incorporate notable inventions.

More specifically, the invention proposes the development of a new rail-changing system that allows for a simple and reliable structure, applicable to a large number of rails, and which does not require high accuracy in the tolerances so that is used correctly.

In the state of the art there are known devices that divert carriages of air transport systems. Some of the known types consist of actuating parts of a track, such that there is a segment that actively diverts the path of the rail. These types of rails represent a technically complex and costly solution.

On the other hand, there are passive rail systems from which the transport carriages that circulate with rolling assemblies, suitable for modifying the path of the carriage, hang.

An example of the second type of system is represented by the invention disclosed in the document FR472199A. This system has several disadvantages, the most important one being the transition of loads during the change in direction. With the configuration of two wheels and a lower guiding element 6 on the primary segment, there is a moment in which the bearings have to jump from one beam to another without a guide and, in addition, the jump is conditioned by the size of the plates 8, since if there is to be a solid assembly, the thickness of the plates 8 must be significant and therefore, the jump between beams is as well, thus multiplying the risk of locking the wheels. Furthermore, the defined configuration would not be able to pull the assembly since there would not be any space to transmit momentum towards the wheels. In the case of transmitting momentum through the plate 8, its dimensions would increase, making the jump between the beams much bigger and making it easier to lock the wheels between the beams. Furthermore, the system is configured to be used on beams with standard profiles, with wheels adapted to the tilt of the wedge flanges of said profile, which increases the risk of locking or an abrupt jump that disturbs the balance of the load. The track selection system is based on the actuation of lugs on oscillating arms with a horizontal rotational axis; this system requires a lug to be raised completely and the other one lowered correctly so that the change in direction takes place without tolerances; if the system does not raise it properly, the change in direction cannot take place.

The document U.S. Pat. No. 3,628,462 reproduces most of the disadvantages mentioned, since it has two main wheels upon which the load to be transported lies. The gap between beam segments cannot be very large given the risk of locking. Furthermore, the guiding system includes oscillating arms that rotate horizontally, and are equipped with bearings that must fit perfectly into a guiding side channel. If the oscillating arm is not raised to the correct height, the bearing will not fit into the groove and the change in direction will not take place. In case of wanting to pull the rolling assembly, the increase in the thickness of the plates 27 would make the gap between the segments that must be jumped by the main wheels relatively large, leading to the locking or an abrupt jump, disrupting the balance of the load. Furthermore, the rail-changing mechanism "pushes" the assembly, disrupting the balance of the carried load.

There is, therefore, the need for a track-changing system that resolves the aforementioned problems.

SUMMARY OF THE INVENTION

The present invention has been developed in order to provide a bearing assembly, an arrangement of beams for changing the direction of a carriage with the bearing assembly and a rail-changing system, with said bearing assembly and arrangement of beams that solve the disadvantages mentioned above while also contributing other additional advantages, which will become evident from the description provided below.

It is worth noting that in the present specification, the word "beam" is understood to encompass a track, a rail or similar. On the other hand, the use of the terms upper, lower, side, front, rear, top, bottom, horizontal, vertical, etc. should be understood as a situation at rest.

Therefore, a first object of the present invention is a bearing assembly, of the type that is linked to a carriage of those used in an air transport system on beams, which comprises at least one frame linked to a pair of elongated extensions such that a configuration similar to a yoke is configured, each extension comprising at least one pair of main wheels with a common rotational axis arranged horizontally, the main wheels being able to circulate on a beam; the extension further comprises at least one auxiliary wheel for each main wheel, the auxiliary wheel being arranged in such a way that its rotational axis is perpendicular to the rotational axis of the main wheel in a direction in which the bearing assembly moves, and the auxiliary wheel being able to circulate on a beam; the bearing assembly also comprises at least one cam arranged on a rotating basis between the extensions, such that the rotational axis of the cam is arranged vertically, the cam comprising stop means on its free end.

Thanks to these characteristics, there is a bearing assembly that allows for a jump without the risk of locking, independently of the thickness of the extensions. The configuration ensures the stability of the loads during the change in direction since there are always two main wheels that support the weight and the gap can be relatively bigger than that of the state of the art.

Another advantage is the fact that the beams used in the present bearing system are not required to be of a standard or very specific type, as occurs in the state of the art.

The particular arrangement of the cam means the turning system is not required have high accuracy on the relative tolerances between the beams and the bearing of the cam. Furthermore, even if the cam has not made a complete rotation, it is possible that it can change direction without "perfect" execution. The cam does not push the rest of the assembly laterally, but instead rotates it, directing it on the "Z" coordinate axis.

To make ideal lateral contact between the bearing assembly and the web of a beam, the extension can comprise four auxiliary wheels for each main wheel, with the main wheel arranged between two pairs of auxiliary wheels in the direction in which the bearing assembly moves. Advantageously, the auxiliary wheels can be linked to the extensions through a pair of plates arranged perpendicularly and on both sides of the pair of main wheels in a direction in which the bearing assembly moves.

According to a characteristic of the invention, the stop means comprise at least one rolling element, the rotational axis of which is vertical. This rolling element reduces friction with the parts that drive the change in direction. Thanks to the configuration of the present bearing assembly, it can comprise first means of actuation linked to at least one main wheel. These first means of actuation can comprise a driving unit linked to the main wheel by means of a first belt or similar. Although it may increase the thickness of the extension, as mentioned above, a smooth transition between the beams is achieved, without jolts.

The bearing assembly can comprise second means of actuation linked to the cam, thus creating an automated and predefined movement of that cam.

To further facilitate the change in direction, the present bearing assembly can comprise at least guiding means linked in a flexible way to the extension, so that the possible irregularities in the beam are absorbed. These guiding means can have a pair of wedge elements of a trapezoidal profile and made of a material with elastic properties, in which both wedge elements are located above and below the rotational axis of the main wheels. The wedge element can act by coming in contact with a portion of the beam.

In addition, the bearing assembly can comprise a pair of cams arranged on both sides of the frame in a direction in which the bearing assembly moves. This arrangement makes guiding the rotation of the bearing assembly when the direction changes much more precise. To absorb the possible irregularities of the beam, the cam can be articulated in an elastic way with respect to the frame.

Another object of the present invention is an arrangement of beams for changing the direction of a carriage with a bearing assembly as previously described, the beams being rails of the passive type, comprising a primary central segment and at least one pair of secondary central segments, in which at least one of the secondary central segments has a deviation of direction with respect to the primary central segment in plan view; the primary and secondary central segments that have a transverse cross section that comprises at least one web and one flange such that they form an inverted "T", in which the arrangement of beams comprises at least one side segment that runs at a distance from at least one primary central segment and one secondary central segment, the side segment having a transverse cross section in an "L" shape that comprises a flange and a web, such that the flanges of the central segments and the side segments can receive the main wheels of the same extension, and the webs of the central segments and the side segments can receive the auxiliary wheels of the same extension, the central segments comprising ends without a web and facing each other respectively, defining a gap between the distanced central segments, the webs of the side segments being able to come in contact with the stop means and the auxiliary wheels on both sides of the web when in use.

Thanks to these characteristics, it is possible to use multiple beam types without them being standard or very specific. Furthermore, the relative tolerances between the beams do not have to be relatively small. It is ensured that there will always be a pair of main wheels supported on the flanges to adequately support the load. Guiding is achieved during the full transition from a primary central segment to a secondary central segment, due to the side segments. Relatively reduced tolerance between the bearing assembly and the different segments is not required.

To facilitate the rotation of the cams to their ideal position, the side segments can comprise an inclined portion of a web which is turned towards the central segments. Thus, a smooth and precise transition takes place.

An additional object of the present invention is a rail-changing system for air transport systems that comprises a bearing assembly as described previously and an arrangement of beams for changing direction as described previously.

Other characteristics and advantages of the rolling assembly, the arrangement of beams and the rail-changing system, object of the present invention, will become clear in light of the description of a preferred, though non-exclusive, embodiment, which, by way of a non-limiting example, is illustrated in the accompanying drawings, wherein:

DESCRIPTION OF SPECIFIC EMBODIMENTS OF THE INVENTION

As is shown in the attached figures, a rail-changing system is illustrated, designated in a general way by the numerical reference 100 which comprises a bearing assembly designated in a general way by the numerical reference 200 and an arrangement of beams designated in a general way by the numerical reference 300.

Figure 2:
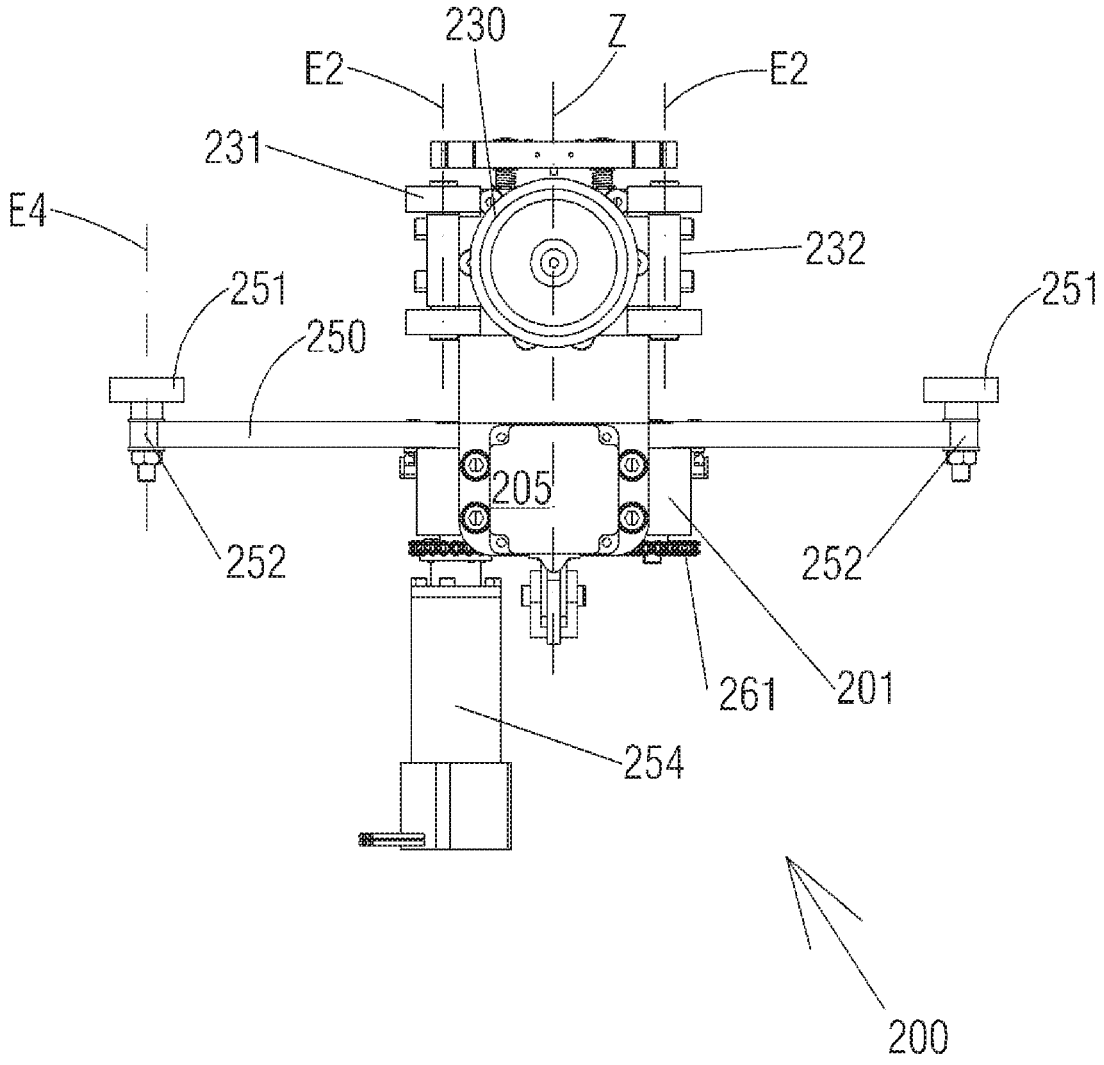
FIG. 2 shows a schematic side view of the bearing assembly of FIG. 1.
Figure 3:
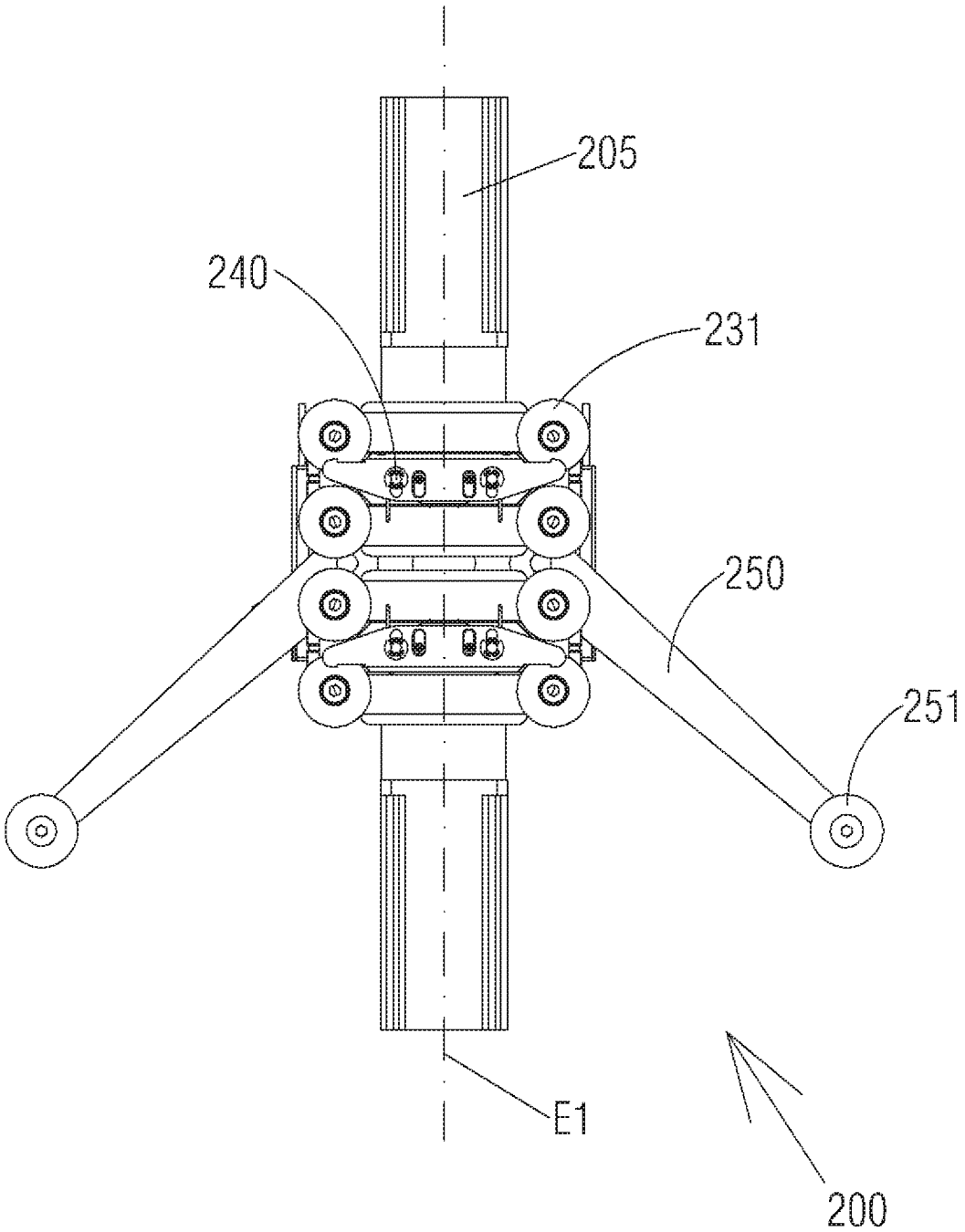
FIG. 3 shows a schematic plan view of the bearing assembly of FIG. 1.
Figure 5:
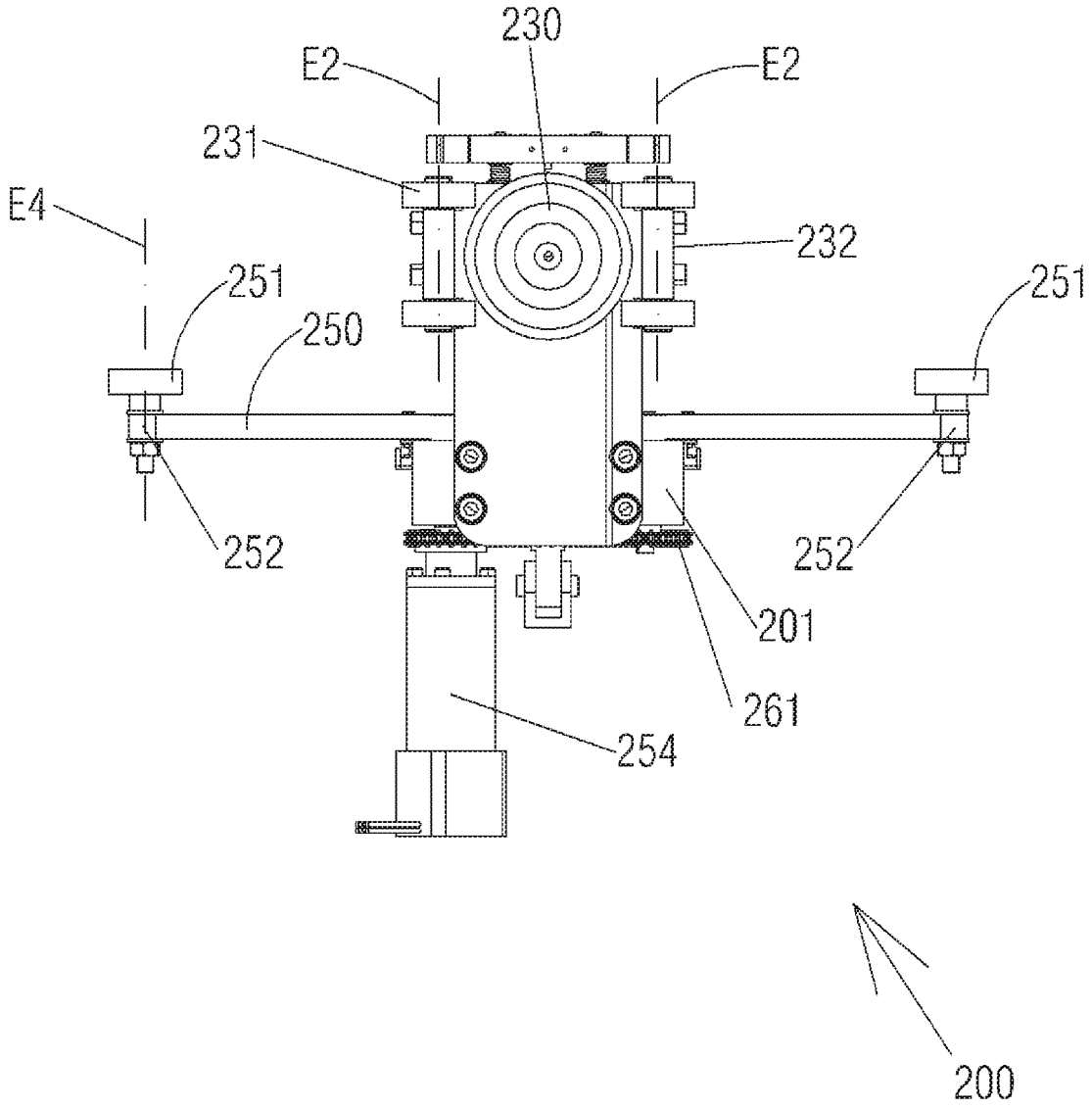
FIG. 5 shows a schematic side view of the bearing assembly of FIG. 4.
Figure 6:
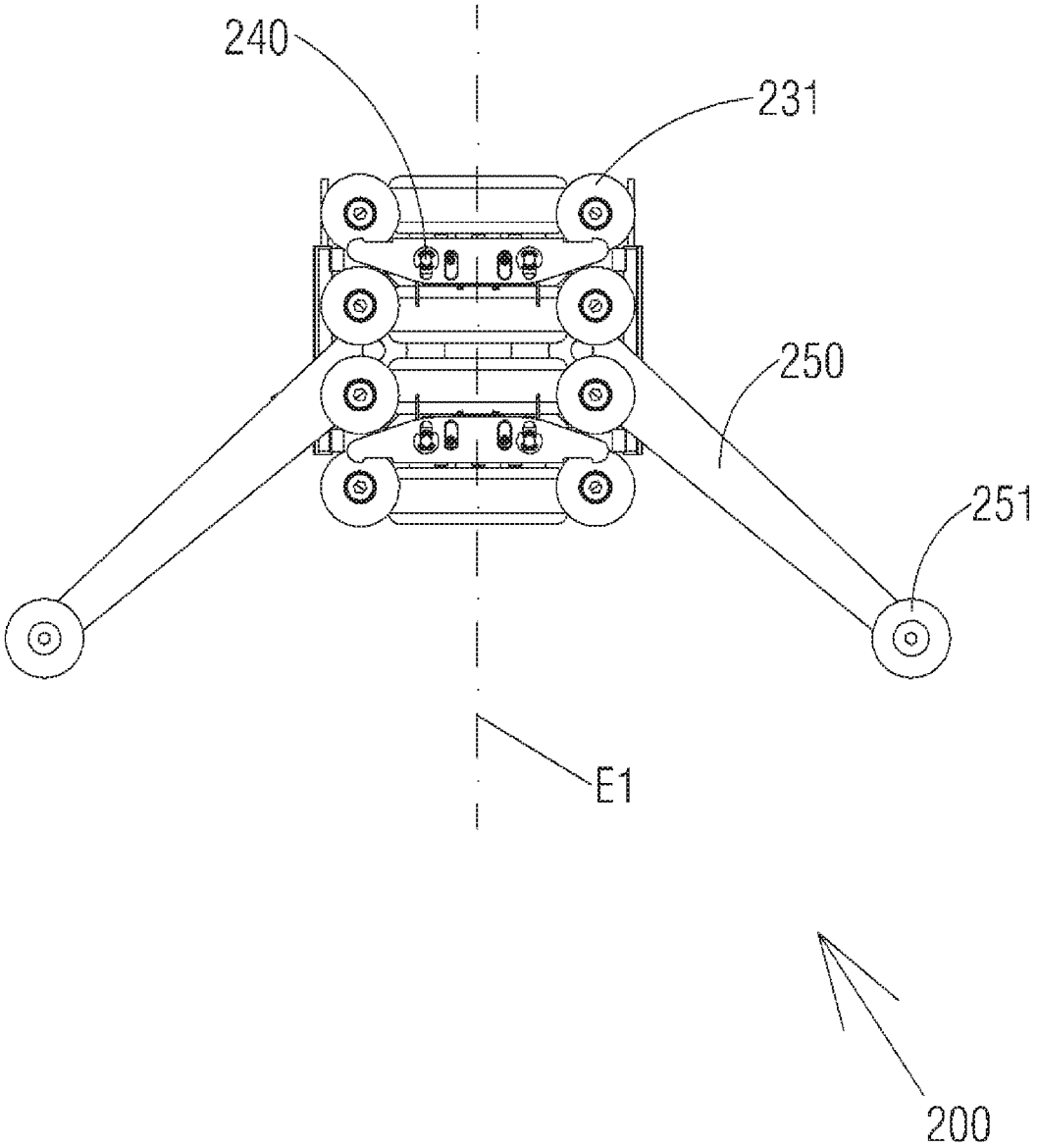
FIG. 6 shows a schematic plan view of the bearing assembly of FIG. 4.
Figure 7:
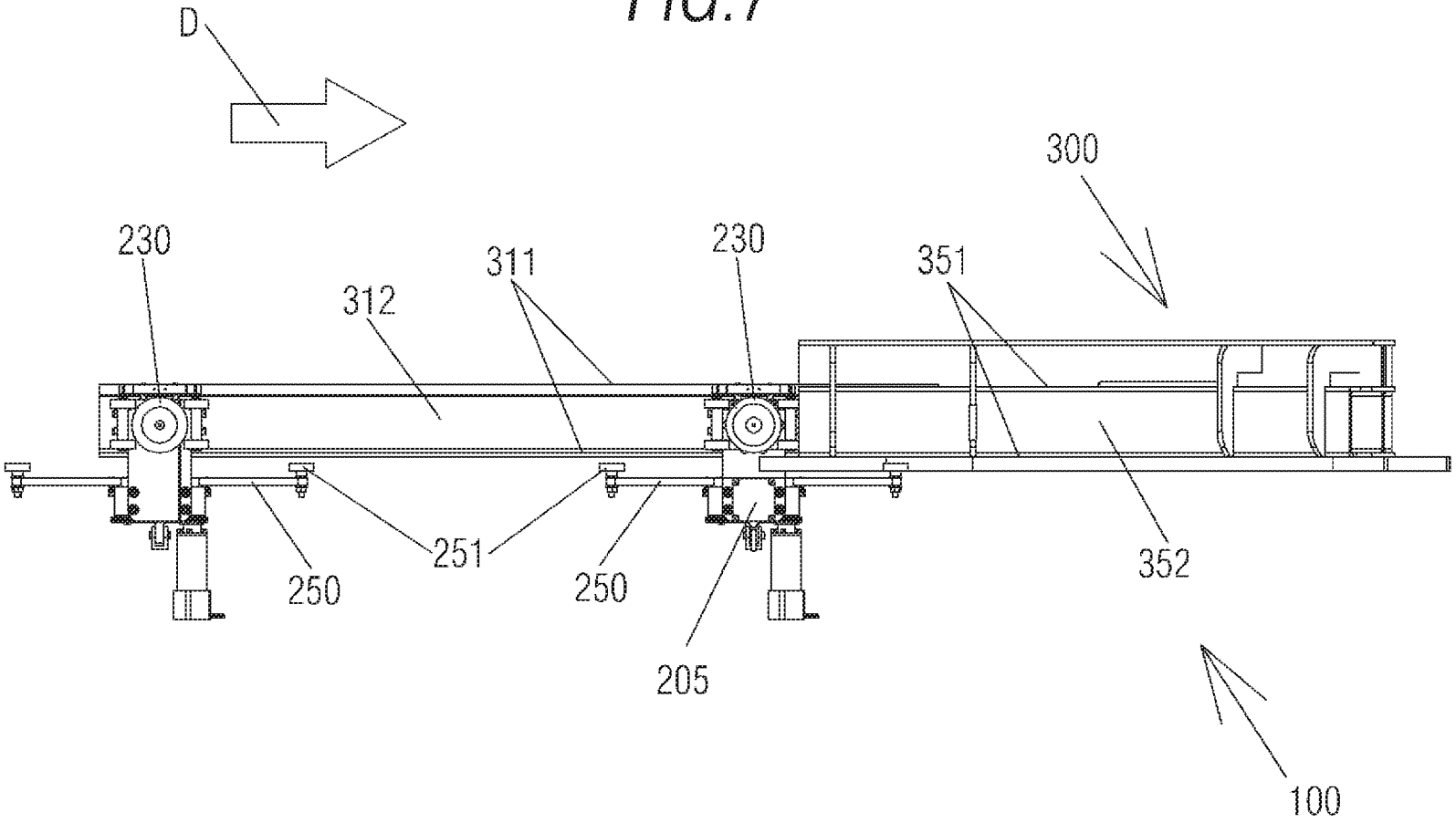
FIG. 7 shows a schematic side view of bearing assemblies on an arrangement of beams upon which the cams are arranged to follow a straight path.

The bearing assembly 200 is of the type that is linked to a carriage (not shown) of those used in an air transport system on beams. The type of carriage will not be further discussed since it can be any of those available in the market. In the attached figures, two fundamental embodiments of bearing assemblies 200 have been shown, one of a motor type in FIGS. 1-3 and another free, in other words, without motor functions, such as those in FIGS. 4-6.

Figure 1:
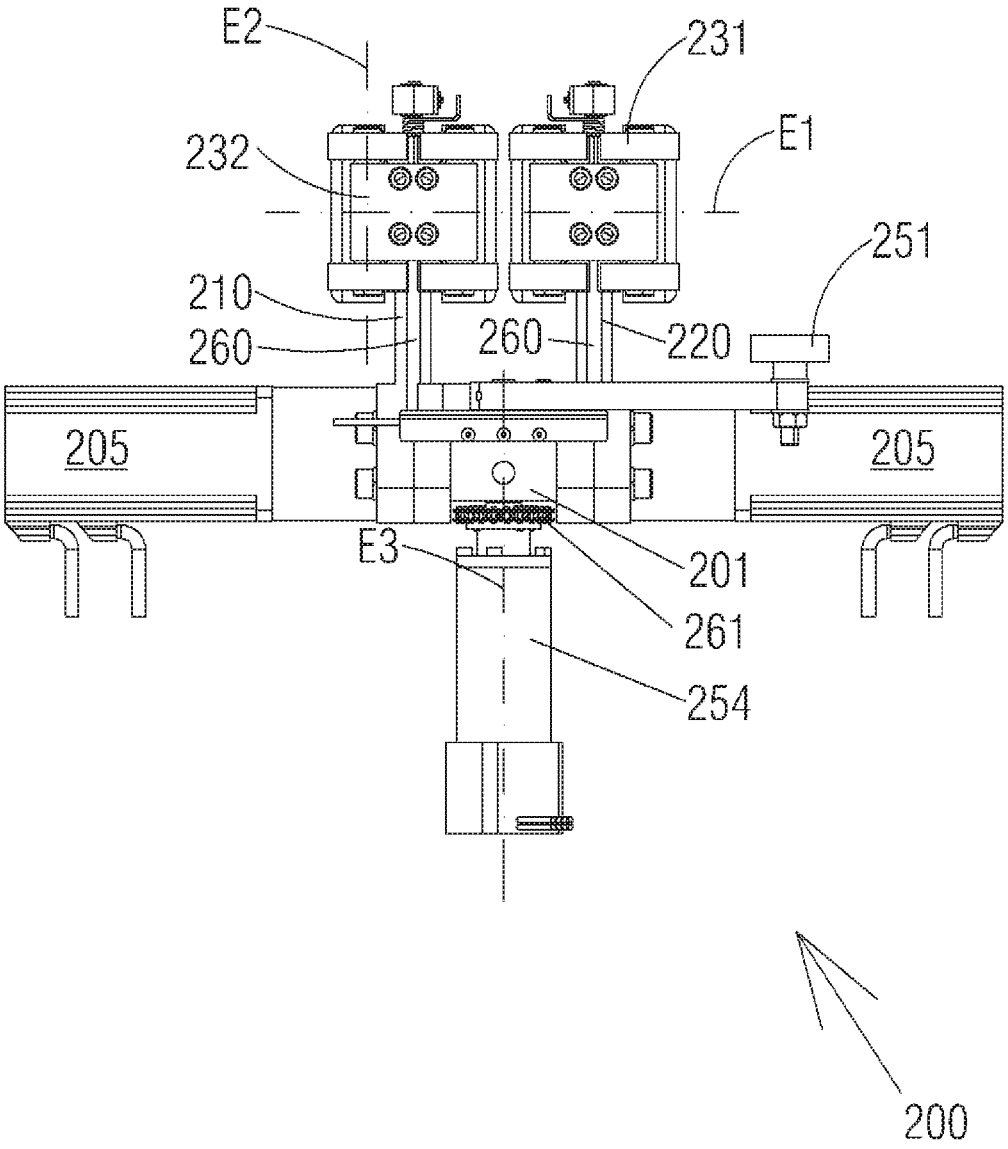
FIG. 1 shows a schematic elevational view of a motor bearing assembly according to the invention.
Figure 4:
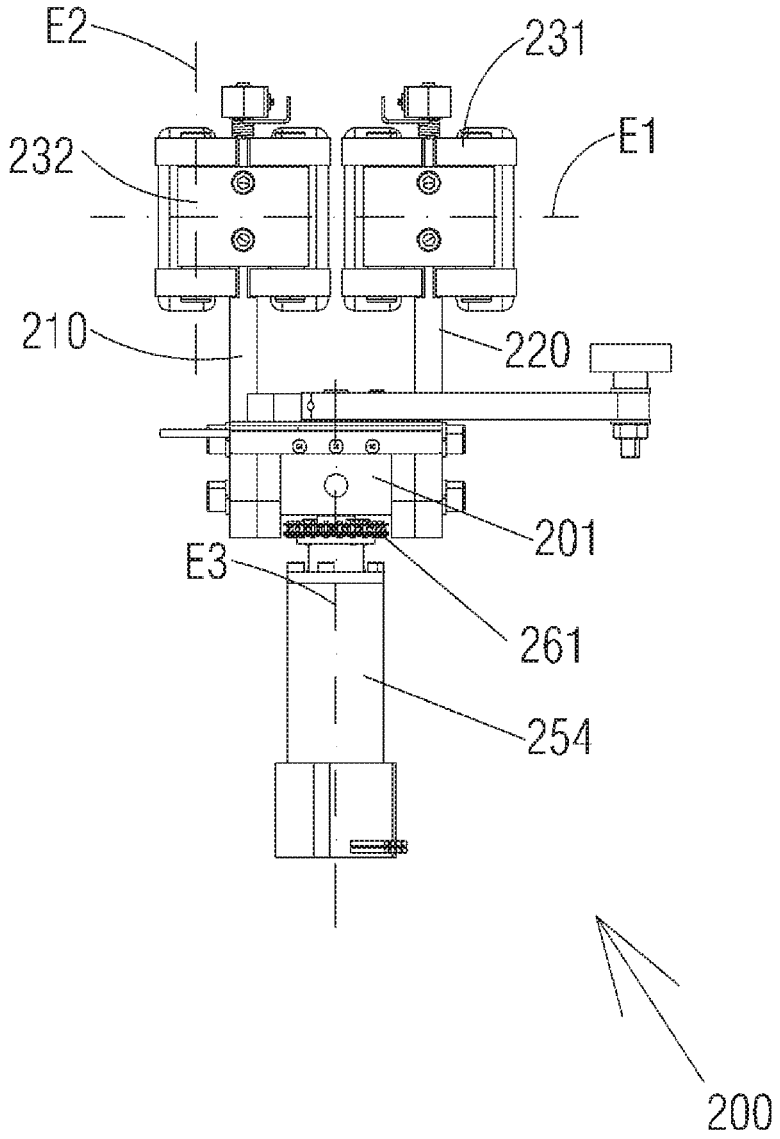
FIG. 4 shows a schematic elevational view of a free bearing assembly according to the invention.

Each bearing assembly 200 preferably comprises a frame 201 linked to a pair of elongated extensions 210, 220, such that it defines a configuration similar to a yoke (see FIGS. 1 and 4). The extensions 210, 220 are preferably laminar elements capable of sustaining, for example, a pair of main wheels 230 with a common rotational axis E1 arranged horizontally. The main wheels 230 are able to circulate on a beam, such that the rotational axis E1 becomes essentially perpendicular to the line described by the beam, in the plan view.

By having a pair of extensions 210, 220, in which there is a pair of main wheels 230, at least four main wheels 230 are obtained, such that they will preferably share a common rotational axis E1, since this will logically facilitate the operation when the direction changes.

The extension 210, 220 additionally and preferably comprises four auxiliary wheels 231 for each main wheel 230, the auxiliary wheels 231 arranged in a way that their rotational axis E2 is essentially perpendicular to the rotational axis E1 of the main wheel 230 in a front view (see FIG. 1) and the auxiliary wheels 231 being able to circulate on a beam, particularly a beam web.

The auxiliary wheels 231 have a rotational axis E1 arranged horizontally. Although in the present embodiment there are four auxiliary wheels 231 for each main wheel 230, a person skilled in the art can modify the number taking into account the needs.

The main wheel 230 arranged between two pairs of auxiliary wheels 231 in the direction D in which the bearing assembly 200 moves. The auxiliary wheels 231 are linked to the extensions 210, 220 through a pair of plates 232 arranged perpendicularly and on both sides of the pair of main wheels 230 in a direction in which the bearing assembly 200 moves.

It can also be seen that the bearing assembly 200 preferably comprises a pair of cams 250 arranged on both sides of the frame 201 in a direction D in which the bearing assembly 200 moves. Each cam 250 is arranged on a rotating basis between the extensions 210, 220, in such a way that the rotational axis E3 of the cam 250 is arranged vertically. Each cam 250 is articulated in an elastic way with respect to the frame 201, for example, with a spring or similar, such that it dampens the irregularities that the route may have. The cam 250 also comprises stop means on its free end 252. The stop means preferably comprise a rolling element 251, the rotational axis E4 of which is vertical. This rolling element 251 will be responsible for making some beam or similar of the chosen path come in contact with some control means (not shown).

In the case of the motor embodiment of the bearing assembly 200, it comprises first means of actuation preferably linked to each pair of main wheels 230. The first means of actuation comprise a drive unit 205 linked to each pair of main wheels 230 by means of a first belt 260 or similar, for example, a chain. Thanks to the configuration of the first invention, despite the fact that the extensions 210, 220 should house that first belt 260 and that the thickness may increase, the invention will continue to offer the same stable, reliable and predictable path change. If the mentioned documents of the state of the art include a first belt 260 or similar, the increase in the thickness of its extensions would significantly hinder the change in direction.

In the present embodiment, a pair of bearing assemblies 200, one motor and the other free, have been chosen, although it is necessary that they both be for motors. In other non-illustrated embodiments, the carriage can have as many bearing assemblies 200 as necessary.

In relation to the cams 250, the bearing assembly 200 preferably comprises second means of actuation 254 linked to a cam 250 through a second belt 261 or chain. These second means of actuation 254 operate when the control means so order it.

Additionally, the bearing assembly 200 further comprises guiding means linked in a flexible way to each extension 210, 220. In the present embodiments, the guiding means have a pair of wedge elements 240 of a trapezoidal profile and made of a material with elastic properties, in which both wedge elements 240 are located above and below the rotational axis E1 of the main wheels 230. The trapezoidal profile allows the guiding means to carry out their function in both travel directions, with the "sharpened points" turned towards the direction of travel. These means with elastic properties and linked in a flexible way to each extension 210, 220 dampen any irregularity of the beams.

Also shown in the attached figures is an arrangement of beams 300 for changing the direction of a carriage (not shown) with a bearing assembly 200 as previously described. The beams are rails of the passive type, and advantageously, they do not have to be beams with a standard profile or with very specific characteristics, and with the resulting cost increase. The configuration of the present arrangement of beams 300 means the beams do not have to have relatively strict tolerances, as occurs in the state of the art.

The present preferred embodiment of the arrangement of beams 300 comprises a primary central segment 310 and a pair of secondary central segments 320, 330, in which one of the secondary central segments 330 has deviation of direction with respect to the primary central segment 310 in plan view (see FIGS. 8 and 10), in other words, moving in direction D. Despite the name "primary central segment" and "secondary central segments", it should not be understood that the bearing assembly 200 will always change from the first to the second segment, since reversing the direction in which the carriage travels is not ruled out and logically, the order of the segments will also be reversed.

Preferably, the primary 310 and secondary 320, 330 central segments have a transverse cross section that comprises at least one web 312, 322, 332 and a flange 311, 321, 331, such that an inverted "T" is defined. It is obvious that if necessary, a person skilled in the art could use a standard profile in which the flanges 311, 321, 331 are linked together by a web 312, 322, 332.

Figure 8:
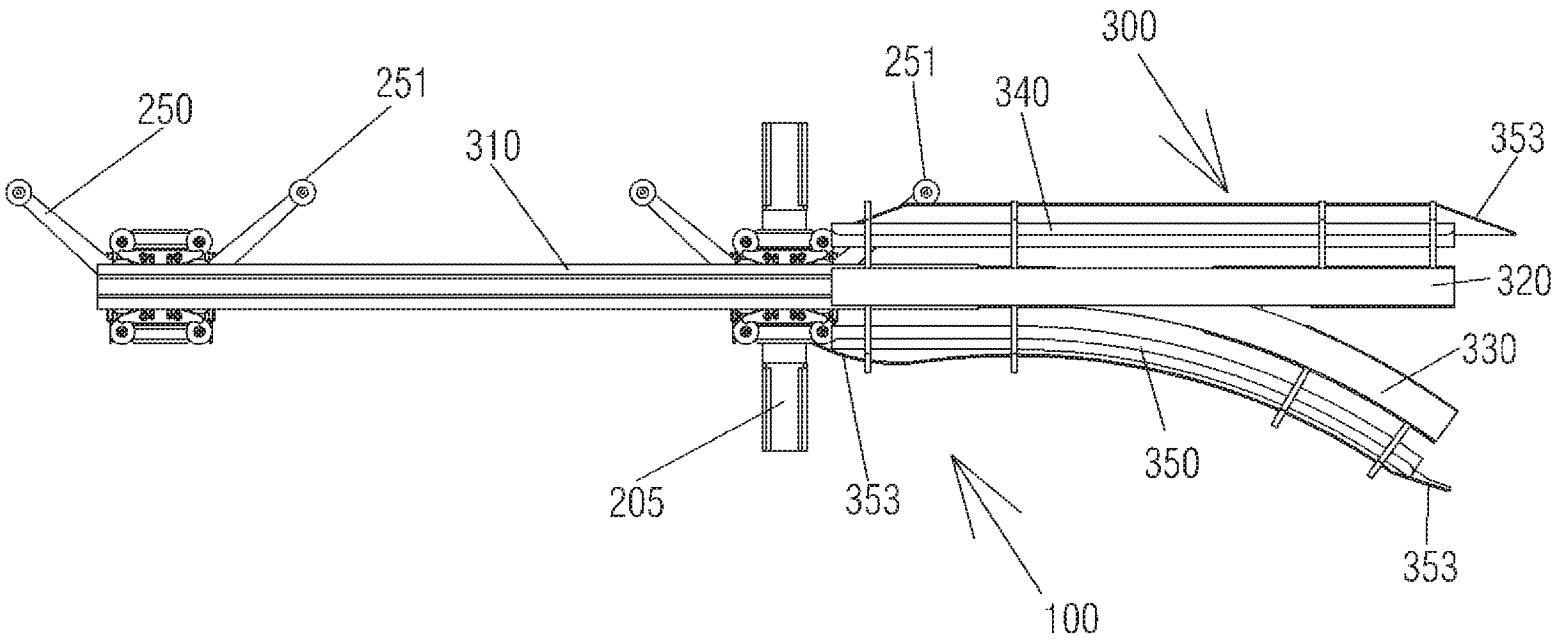
FIG. 8 shows a schematic plan view of the bearing assemblies and a portion of the arrangement of beams of FIG. 7.
Figure 9:
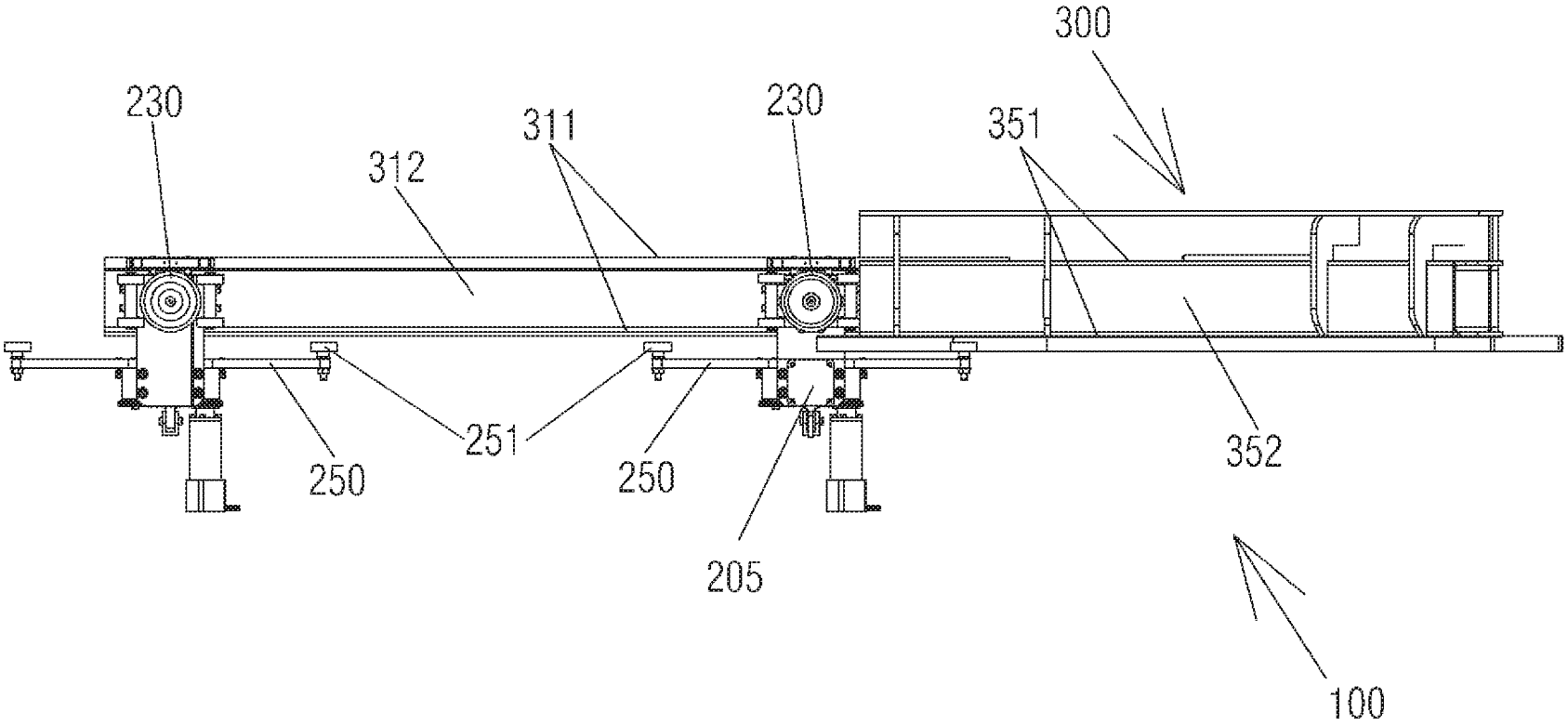
FIG. 9 shows a schematic side view of the bearing assemblies and the arrangement of beams of FIG. 7 upon which the cams are arranged to modify the path.
Figure 10:
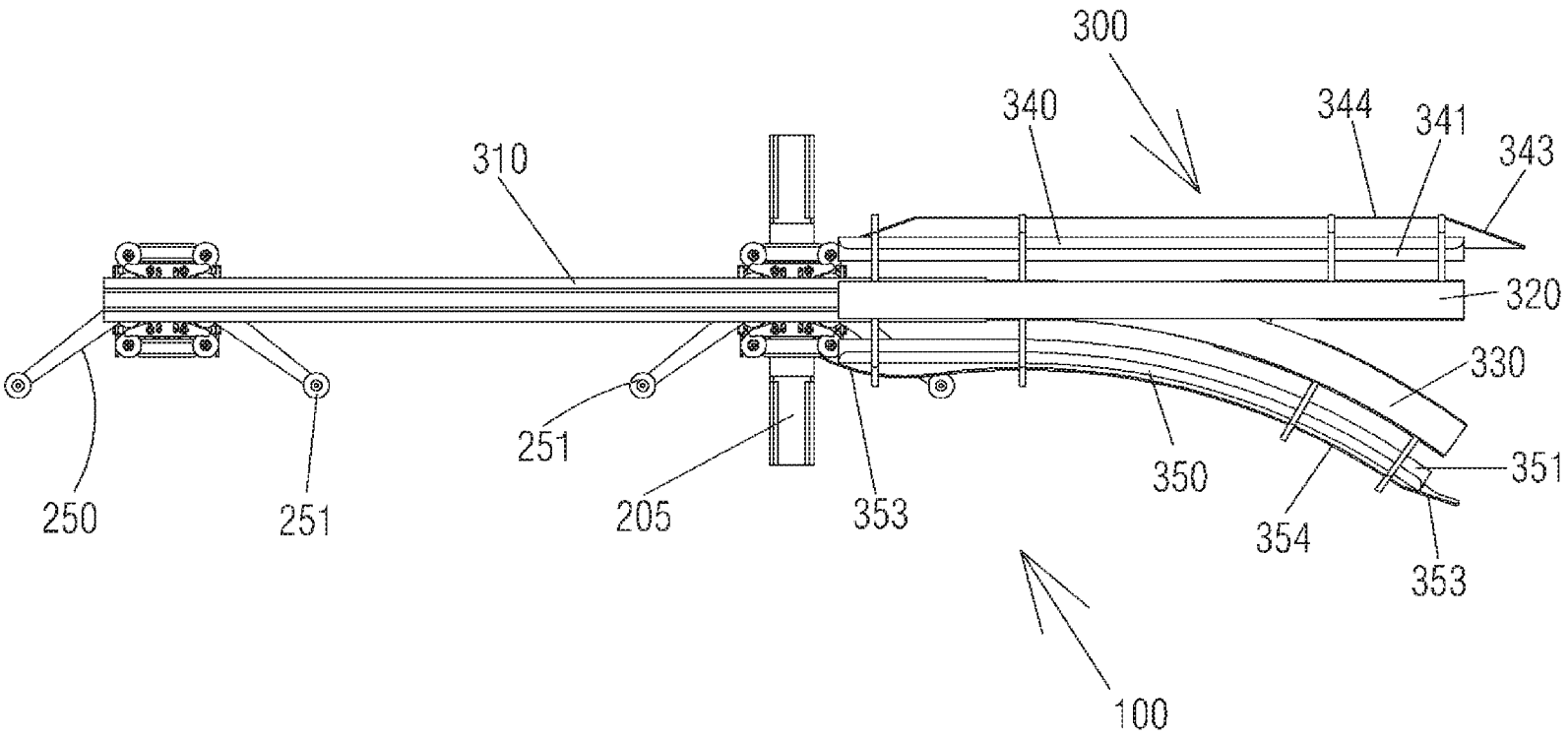
FIG. 10 shows a schematic plan view of the bearing assemblies and a portion of the arrangement of beams of FIG. 9.

The arrangement of beams 300 preferably comprises a pair of side segments 340, 350 that runs at a distance from the primary central segment 310 and each one of the secondary central segments 320, 330, all in plan view (see FIGS. 8 and 10).

Each side segment 340, 350 has a transverse cross section in an "L" that comprises a flange 341, 351 and a web 342, 352, such that the flanges 311, 321, 331, 341, 351 of the central segments 310, 320, 330 and the side segments 340, 350 can receive the main wheels 230 of the same extension 210, 220. In other words, the flanges 311, 321, 331 of the central segments 310, 320, 330 and the flanges 341, 351 of the side segments 340, 350 are turned to face each other.

The webs 312, 322, 332, 342, 352 of the central segments 310, 320, 330 and the side segments 340, 350 can receive the auxiliary wheels 231 of the same extension 210, 220. In other words, the webs 312, 322, 332 of the central segments 310, 320, 330 and the webs 342, 352 of the side segments 340, 350 are turned to be essentially parallel to each other.

Each central segment 310, 320, 330 comprises ends 313, 323, 333 lacking a web so that the main wheels 230 can change direction without encountering vertical obstacles. Said ends 313, 323, 333 face each other, such that the ends 323, 333 of the secondary central segments reciprocally face the end 313 of the primary central segment 310.

As has been made clear, the ends 313, 323, 333 face each other such that a gap 360 is defined respectively between the separated central segments 310, 320, 330.

Figure 11:
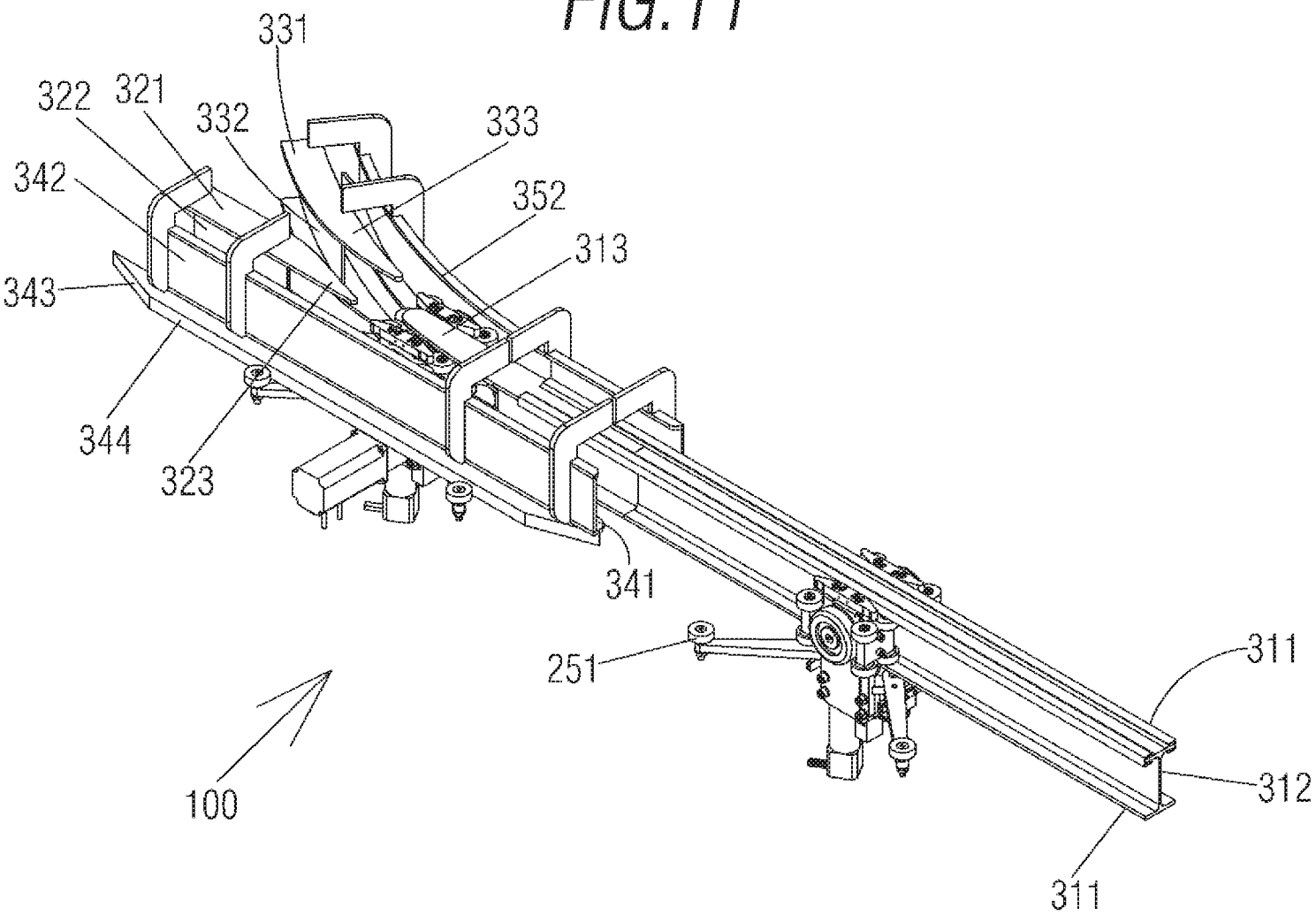
FIG. 11 shows a schematic perspective view of a rail-changing system according to the invention upon which the cams are arranged to follow a straight path.
Figure 12:
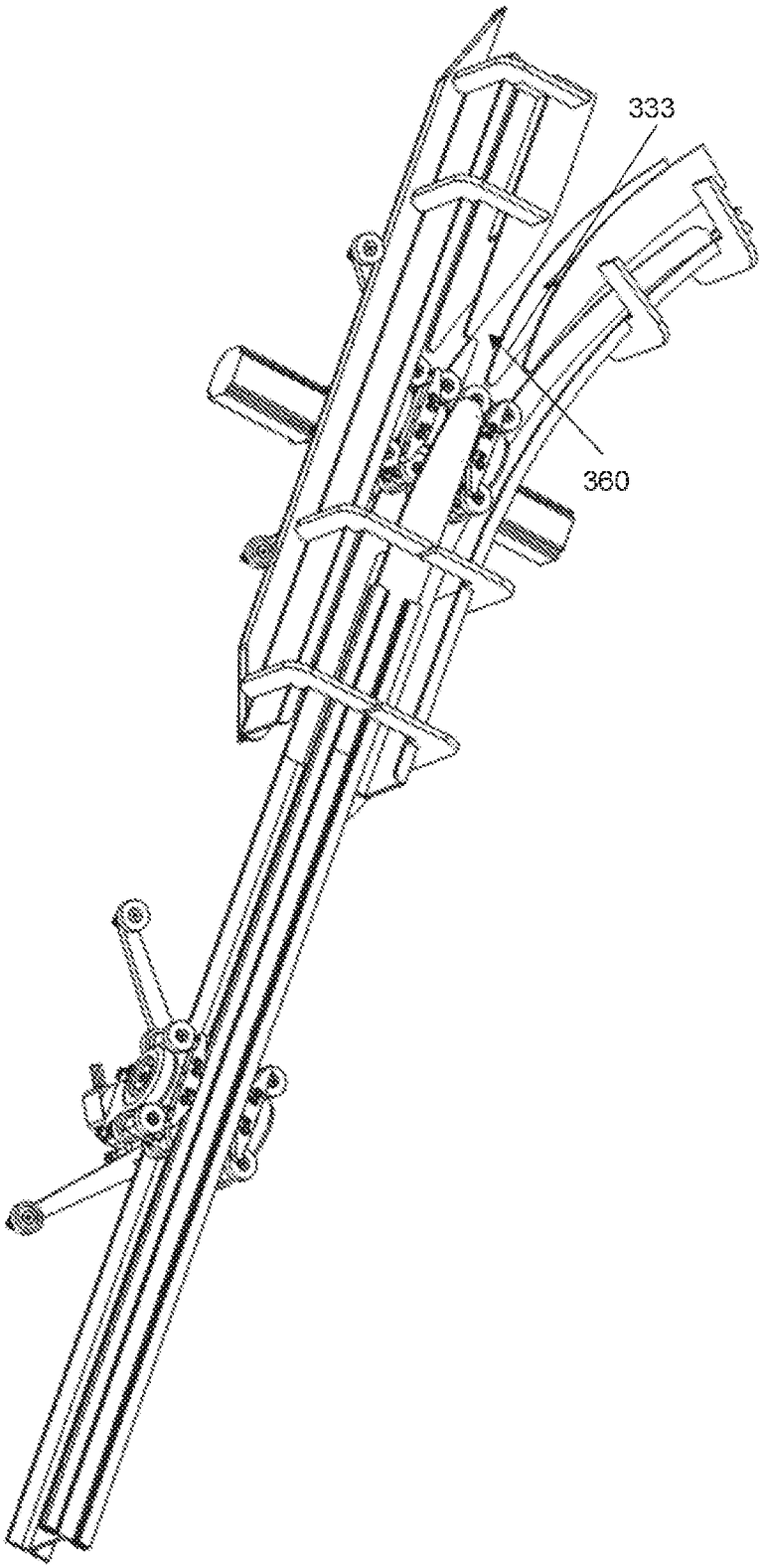
FIG. 12 shows a schematic view from another perspective of a rail-changing system according to the invention in which there is no path change.
Figure 13:
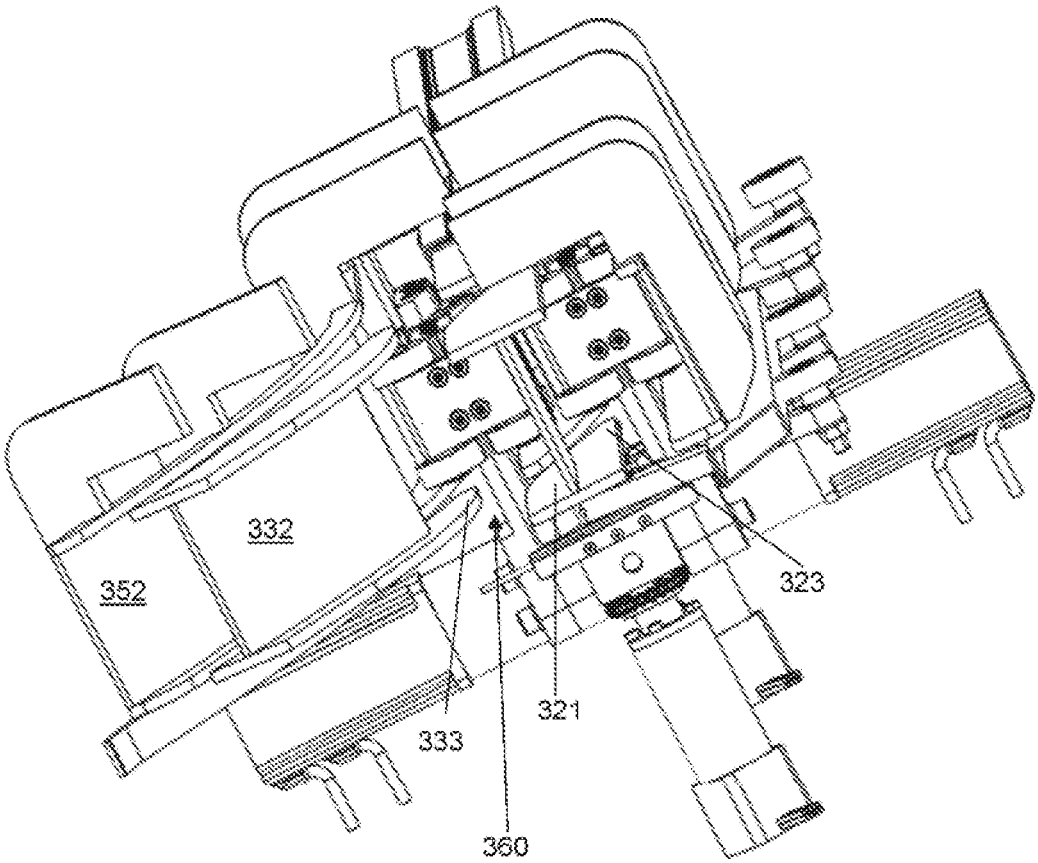
FIG. 13 shows a schematic view from another perspective of the rail-changing system of FIG. 12.

The webs 352 of the side segments 340, 350 can come in contact with the stop means and the auxiliary wheels 231 on both sides of the web 352 when in use, as can be seen in FIGS. 8, 10 and 11. In some embodiments, the side segments 340, 350 can have a protrusion 344, 354 wherein they come in contact with the rolling elements 251. These protrusions 344, 345 can be designed to more precisely define the path of the carriage when the direction changes.

Preferably, the side segments 340, 350 comprise an inclined portion 343, 353 of a web 342, 352 and turned towards the central segments 310, 320, 330. These inclined portions 343, 352 direct the relative "contact point" between the rolling elements 251 and the side segments 340, 350.

When in use, as shown in FIGS. 7-11, the carriage, hanging from the arrangement of beams 300 by means of the bearing assembly 200, circulates through the frame 201. Under these conditions, only the main wheels 230 and the auxiliary wheels 231 closest to the web 312 and to the flanges 311 of the primary central segment 310 are those that support the load of the carriage.

When the direction is about to change, some control means can order the second drive means to make the cams 250 turn according to the desired path. The cams 250, which move in an angular and symmetrical way with respect to the extensions 210, 220, reach a position such that the rolling elements 251 properly turn in order to come in contact with the side segments 340 or 350 of the chosen path. When the bearing assembly 200 reaches the arrangement of beams 300, the rolling elements 251 have already come in contact with the side segments 340, 350, and of the four main wheels 230 and sixteen auxiliary wheels 231, the two main wheels 230 and the eight auxiliary wheels 231 closest to said primary central segment 310 respectively roll on their flanges 311 and their web 312, and the two main wheels 230 and the eight auxiliary wheels 231 closest to said side segments 340, 350 respectively roll on their flanges 341, 351 and their web 342, 352.

Next, the rolling assembly 200 reaches the free end 313 of the web and afterwards, it reaches one of the ends 323 or 333, depending on the chosen path. In the embodiment shown, these ends 313, 323 and 333 are symmetrical on the upper and lower part of the beam. Furthermore, at this point and thanks to the configuration of the two drive units 205 independently linked to each pair of main wheels 230, the operation of said drive units 205 can be modified and in this way, a differential effect can be achieved in order to modify the rotational velocity between the different pairs of main wheels 230 linked respectively to each extension 210, 220. With this differential effect, the fact that the present rolling assembly 200 rotates around itself with respect to the geometric axis Z, and is not "dragged" by directional elements such as the state of the art can be reinforced.

Continuing to move towards the chosen secondary central segment 320, 330, the wedge elements 240 of the trapezoidal profile also ensure guiding of the rolling assembly 200 with respect to the web 322 or 332 of the path chosen. In this jump between central segments 310 to 320 or 310 to 330, there will always be two main wheels 230 of the assembly of four which supports and circulates on the beams, ensuring that the load carried by the carriage does not become unbalanced and none of the main wheels 230 lock in the gap 360. Conditioning the line to relatively precise tolerances between segments is avoided, thus facilitating construction as well as its maintenance.

The details, shapes, dimensions and other accessory elements used in the manufacture of the rolling assembly, the arrangement of beams and the rail-changing system of the invention may be conveniently replaced with others which do not depart from the scope defined by the claims which are included below.

What is claimed is:

1. A bearing assembly (200), used in linkage with a carriage which is used in an air transport system on beams, the bearing assembly comprising:

at least one frame (201) linked to a pair of elongated extensions (210, 220) such that a configuration of a "U" shape is configured, each extension (210, 220) comprising at least one pair of main wheels (230), wherein each pair of said at least one pair of main wheels (230) has a shared rotational axis arranged horizontally and wherein each wheel of the at least one pair of wheels is located in a different side of a respective extension, the main wheels (230) being able to circulate on a beam, the extension (210, 220) further comprising at least one auxiliary wheel (231) for each main wheel (230), the auxiliary wheel (231) having a rotational axis perpendicular to the rotational axis of the main wheel (230) and perpendicular to a movement direction (D) of the bearing assembly (200) in operation, wherein the at least one auxiliary wheel (231) being able to circulate on a beam; and at least one cam (250) arranged on a rotating basis between the extensions (210, 220), such that the rotational axis of the cam (250) is arranged vertically, the cam comprising stop means on its free end (252).

2. The bearing assembly (200) according to the claim 1, wherein the extension (210, 220) comprises four auxiliary wheels (231) for each main wheel (230), with the main wheel (230) arranged between two pairs of auxiliary wheels (231) in the direction (D) in which the bearing assembly (200) moves.

3. The bearing assembly (200) according to the claim 2, wherein the auxiliary wheels (231) are linked to the extensions (210, 220) through a pair of plates (232) arranged perpendicularly and on both sides of the pair of main wheels (230) in a direction (D) in which the bearing assembly (200) moves.

4. The bearing assembly (200) according to the claim 1, wherein the stop means comprise at least one rolling element (251), the rotational axis of which is vertical.

5. The bearing assembly (200) according to the claim 1, characterized in that it comprises first drive means linked to at least one main wheel (230).

6. The bearing assembly (200) according to the claim 5, wherein the first drive means comprise a drive unit (205) linked to the main wheel (230) through a first belt (260).

7. The bearing assembly (200) according to the claim 1, wherein it comprises second drive means (254) linked to the cam (250).

8. The bearing assembly (200) according to the claim 1, wherein it comprises at least guiding means linked in a flexible way to the extension (210, 220).

9. The bearing assembly (200) according to the claim 8, wherein the guiding means have a pair of wedge elements (240) of a trapezoidal profile and made of a material with elastic properties, in which both wedge elements (240) are located above and below the rotational axis of the main wheels (230).

10. The bearing assembly (200) according to the claim 1, wherein it comprises a pair of cams (250) arranged at both sides of the frame (201) in a direction of movement of the bearing assembly (200).

11. The bearing assembly (200) according to the claim 1, wherein the cam (250) is articulated in an elastic way with respect to the frame (201).

12. An arrangement of beams (300) for changing the direction of a carriage with a bearing assembly (200) according to the claim 1, the beams being rails of the passive type, comprising a primary central segment (310) and at least one pair of secondary central segments (320, 330), in which at least one of the secondary central segments (320, 330) has a deviation of direction with respect to the primary central segment (310) in plan view, the primary (310) and secondary (320, 330) central segments that have a transverse cross section that comprises at least one web (312, 322, 332) and one flange (311, 321, 331) such that they form an inverted "T", in which the arrangement of beams (300) comprises at least one side segment (34, 350) that runs at a distance from at least one primary central segment (310) and one secondary central segment (320, 330), the side segment (340, 350) having a transverse cross section in an "L" shape that comprises a flange (351) and a web (352), such that the flanges (311, 321, 331, 341, 351) of the central segments (310, 320, 330) and the side segments (340, 350) can receive the main wheels (230) of the same extension (210, 220), and the webs (312, 322, 332, 342, 352) of the central segments (310, 320, 330) and the side segments (340, 350) can receive the auxiliary wheels (231) of the same extension (210, 220), the central segments (310, 320, 330) comprising ends (313, 323, 333) without a web and facing each other, defining a gap (360) between the separated central segments (310, 320, 330), the webs (342, 352) of the side segments (340, 350), respectively, being able to come in contact with the stop means and the auxiliary wheels (231) on both sides of the web (352) when in use.

13. The arrangement of beams (300) for changing the direction of a carriage according to the claim 12, wherein the side segments (340, 350) comprise an inclined portion (343, 353) of a web (342, 352) and turned towards the central segments (310, 320, 330).

14. A rail-changing system for air transport systems, comprising a bearing assembly (200), used in linkage with a carriage which is used in an air transport system on beams, the bearing assembly comprising:

at least one frame (201) linked to a pair of elongated extensions (210, 220) such that a configuration of a "U" shape is configured, each extension (210, 220) comprising at least one pair of main wheels (230), wherein each pair of said at least one pair of main wheels (230) has a shared rotational axis arranged horizontally and wherein each wheel of the at least one pair of wheels is located in a different side of a respective extension, the main wheels (230) being able to circulate on a beam, the extension (210, 220) further comprising at least one auxiliary wheel (231) for each main wheel (230), the auxiliary wheel (231) having a rotational axis perpendicular to the rotational axis of the main wheel (230) and perpendicular to a movement direction (D) of the bearing assembly (200) in operation, wherein the at least one auxiliary wheel (231) being able to circulate on a beam, and at least one cam (250) arranged on a rotating basis between the extensions (210, 220), such that the rotational axis of the cam (250) is arranged vertically, the cam comprising stop means on its free end (252); and an arrangement of beams (300) for changing the direction of a carriage, the beams being rails of the passive type, comprising a primary central segment (310) and at least one pair of secondary central segments (320, 330), in which at least one of the secondary central segments (320, 330) has a deviation of direction with respect to the primary central segment (310) in plan view; the primary (310) and secondary (320, 330) central segments that have a transverse cross section that comprises at least one web (312, 322, 332) and one flange (311, 321, 331) such that they form an inverted "T", in which the arrangement of beams (300) comprises at least one side segment (34, 350) that runs at a distance from at least one primary central segment (310) and one secondary central segment (320, 330), the side segment (340, 350) having a transverse cross section in an "L" shape that comprises a flange (351) and a web (352), such that the flanges (311, 321, 331, 341, 351) of the central segments (310, 320, 330) and the side segments (340, 350) can receive the main wheels (230) of the same extension (210, 220), and the webs (312, 322, 332, 342, 352) of the central segments (310, 320, 330) and the side segments (340, 350) can receive the auxiliary wheels (231) of the same extension (210, 220), the central segments (310, 320, 330) comprising ends (313, 323, 333) without a web and facing each other, defining a gap (360) between the separated central segments (310, 320, 330), the webs (342, 352) of the side segments (340, 350), respectively, being able to come in contact with the stop means and the auxiliary wheels (231) on both sides of the web (352) when in use.

* * * * *